US008105250B2

(12) United States Patent
Wu

(10) Patent No.: US 8,105,250 B2
(45) Date of Patent: Jan. 31, 2012

(54) VIBRATION-EXERCISING MACHINE

(76) Inventor: Mu-Chuan Wu, Tainan Hsien (TW)

( * ) Notice: Subject to any disclaimer, the term of this patent is extended or adjusted under 35 U.S.C. 154(b) by 929 days.

(21) Appl. No.: 12/122,131

(22) Filed: May 16, 2008

(65) Prior Publication Data

US 2009/0234257 A1 Sep. 17, 2009

(30) Foreign Application Priority Data

Mar. 11, 2008 (TW) ..... 97108432 A

(51) Int. Cl.
*A61H 1/00* (2006.01)
*A63B 26/00* (2006.01)
*A63B 22/14* (2006.01)
*A63B 22/02* (2006.01)

(52) U.S. Cl. ..... 601/49; 601/23; 601/61; 482/54; 482/145; 482/146

(58) Field of Classification Search ..... 601/49, 601/46, 56, 61, 64–65, 66, 70, 78, 23, 24, 601/27, 29, 30, 31; 482/77, 27, 54, 146–147, 145, 112, 113
See application file for complete search history.

(56) References Cited

U.S. PATENT DOCUMENTS

2006/0068978 A1* 3/2006 Moon et al. ..... 482/54
2007/0105693 A1* 5/2007 Wang ..... 482/54
2007/0270726 A1* 11/2007 Chou ..... 601/70

* cited by examiner

*Primary Examiner* — Patricia Bianco
*Assistant Examiner* — George N Phillips
(74) *Attorney, Agent, or Firm* — patenttm.us

(57) ABSTRACT

A vibration-exercising machine has a supporting frame, a main platform being mounted on the supporting frame, at least one additional platform being mounted on the supporting frame and multiple vibrators being mounted in each corresponding platform. The vibration-exercising machine allows different parts of a user to be vibrated and exercised efficiently at the same time with easy and comfortable poses.

7 Claims, 9 Drawing Sheets

VIBRATION-EXERCISING MACHINE

BACKGROUND OF THE INVENTION

1. Field of the Invention

The present invention relates to a vibration-exercising machine, especially to a vibration-exercising machine that has multiple platforms with corresponding vibrators and allows users to exercise different parts of their body simply and conveniently.

2. Description of the Prior Arts

A conventional vibration-exercising machine has a platform, a handle and multiple vibrators. The platform is placed on a ground or a floor to allow a user to stand on the platform. The handle is mounted on and protrudes upwardly from the platform to allow the user to hold the handle and stand stably on the platform. The vibrator is mounted in the platform, may be an eccentric block or a cam driven by a motor or a linkage transmission mechanism or may produce sonic waves or see-saw type waves to pass vibrations to the platform.

After setting frequencies and amplitudes of the vibrators, the vibrators vibrate the user from point of contact, generally a user's feet, to exercise muscles and stimulate nerves of the user. Furthermore, the user may change poses to allow other parts their body to become the point of contact to exercise different muscles. Therefore, users may exercise explosive force of muscles, core-stability and recover from injury or keep in good health with the conventional vibration-exercising machine.

However, the conventional vibration-exercising machine has only one platform with vibrators. The user should change their pose to allow alter body parts being the point of contact, but cannot exercise different parts of their body at the same time. Otherwise, since the platform is placed on the ground, some parts of the user's body, like shoulders or back, are hard become point of contact. The conventional vibration-exercising machine is therefore inconvenient.

To overcome the shortcomings, the present invention provides a vibration-exercising machine to mitigate or obviate the aforementioned problems.

SUMMARY OF THE INVENTION

The main objective of the present invention is to provide a vibration-exercising machine that has a supporting frame, a main platform, at least one additional platform being mounted on the supporting frame and multiple vibrators being mounted in corresponding platforms.

The vibration-exercising machine allows different parts of a user to be vibrated and exercised efficiently at the same time. Since the additional platform is mounted higher than the main platform, the user may exercise different parts of their body with easy and comfortable poses.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
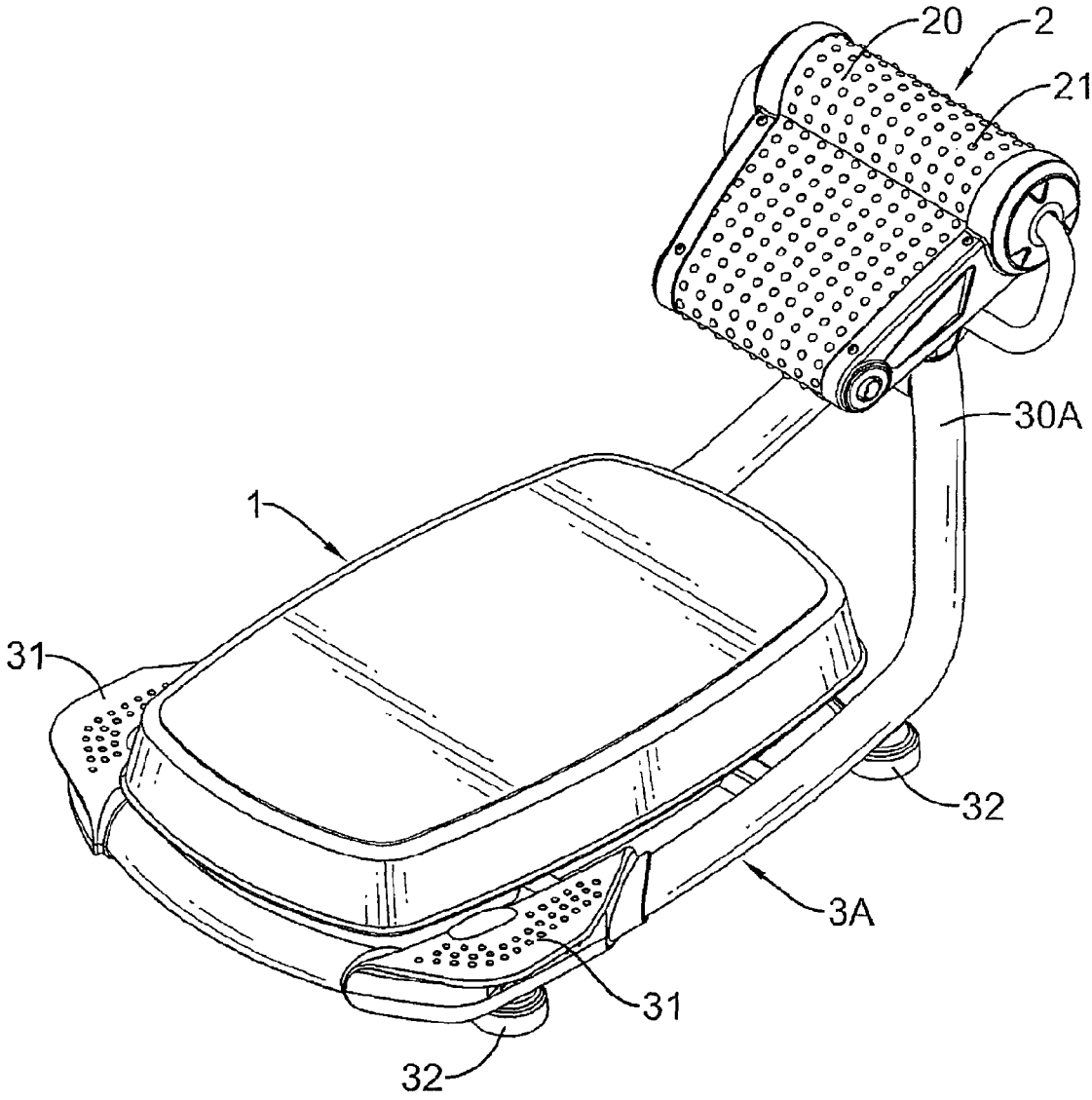
FIG. 1 is a perspective view of a first embodiment of a vibration-exercising machine in accordance with the present invention.

With reference to FIGS. 1, 4 to 10, a vibration-exercising machine in accordance with the present invention comprises a supporting frame (3A, 3B), a main platform (1), at least one additional platform (2), at least one first vibrator (6), at least one second vibrator (60), at least one optional holding frame (4A, 4B) and a controller (5).

Figure 2:
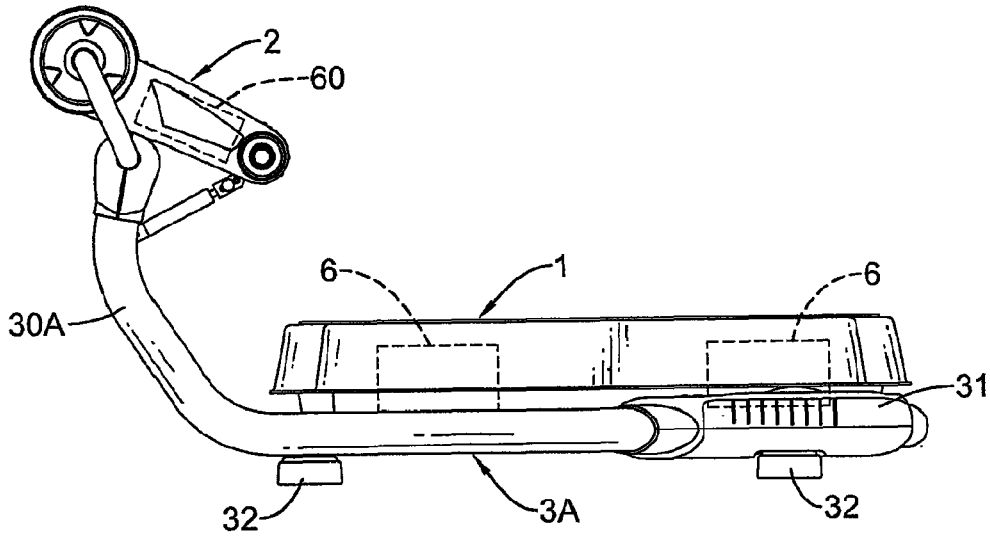
FIG. 2 is a side view of the vibration-exercising machine in FIG. 1.
Figure 3:
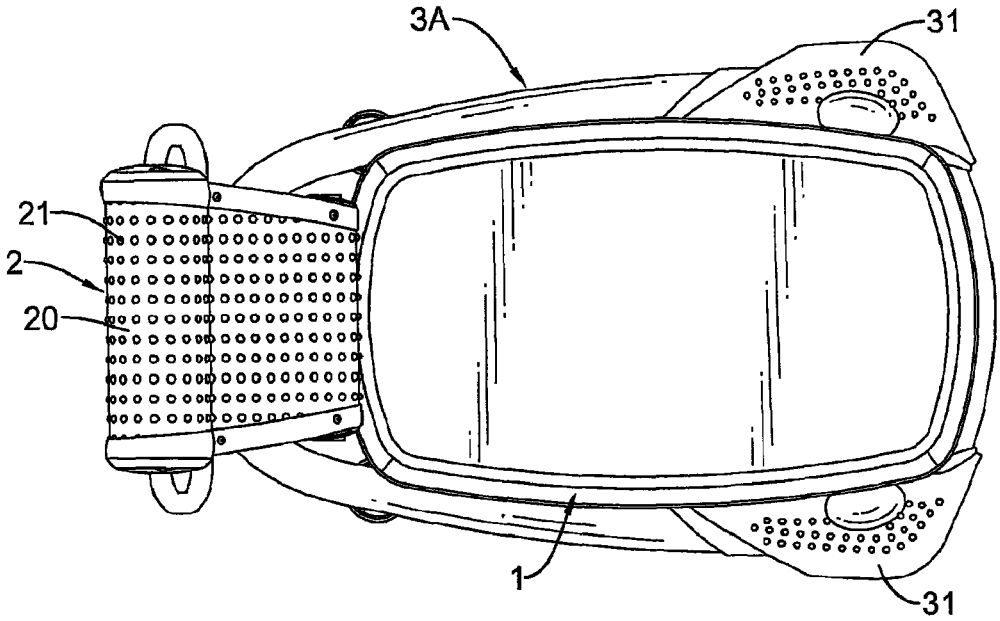
FIG. 3 is a top view of the vibration-exercising machine in FIG. 1.
Figure 4:
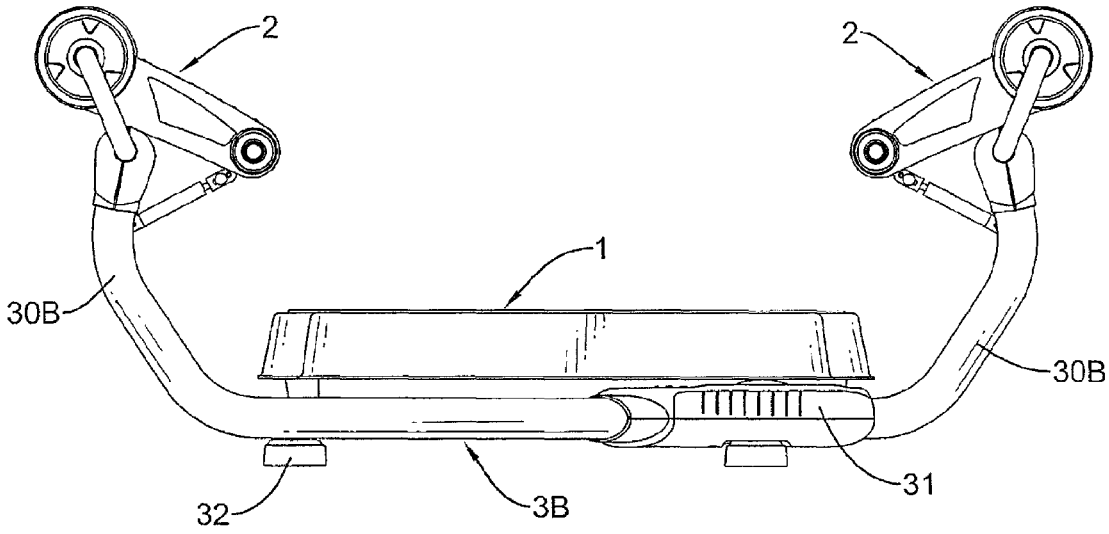
FIG. 4 is a side view of a second embodiment of a vibration-exercising machine in accordance with the present invention.
Figure 5:
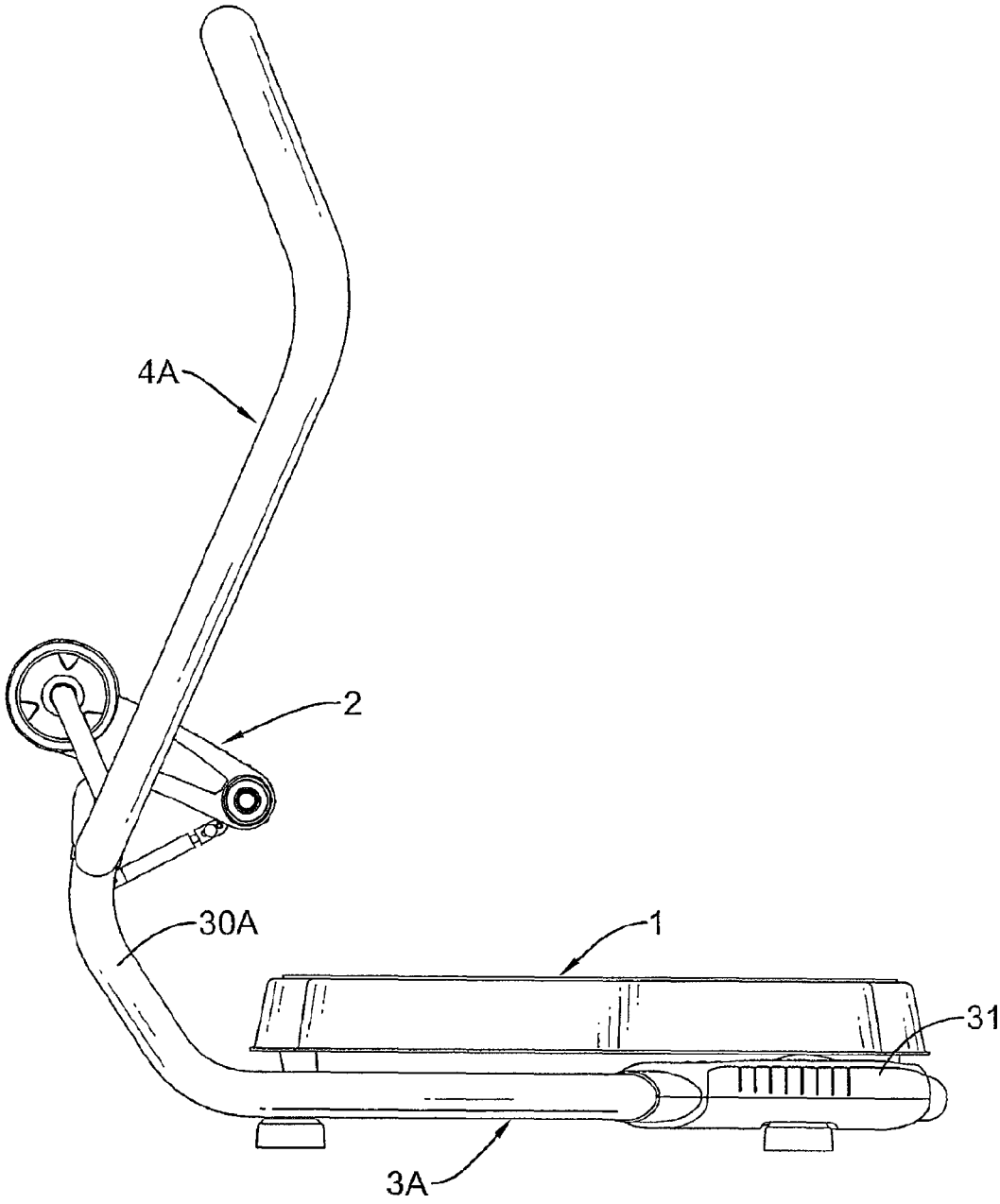
FIG. 5 is a side view of a third embodiment of a vibration-exercising machine in accordance with the present invention.
Figure 6:
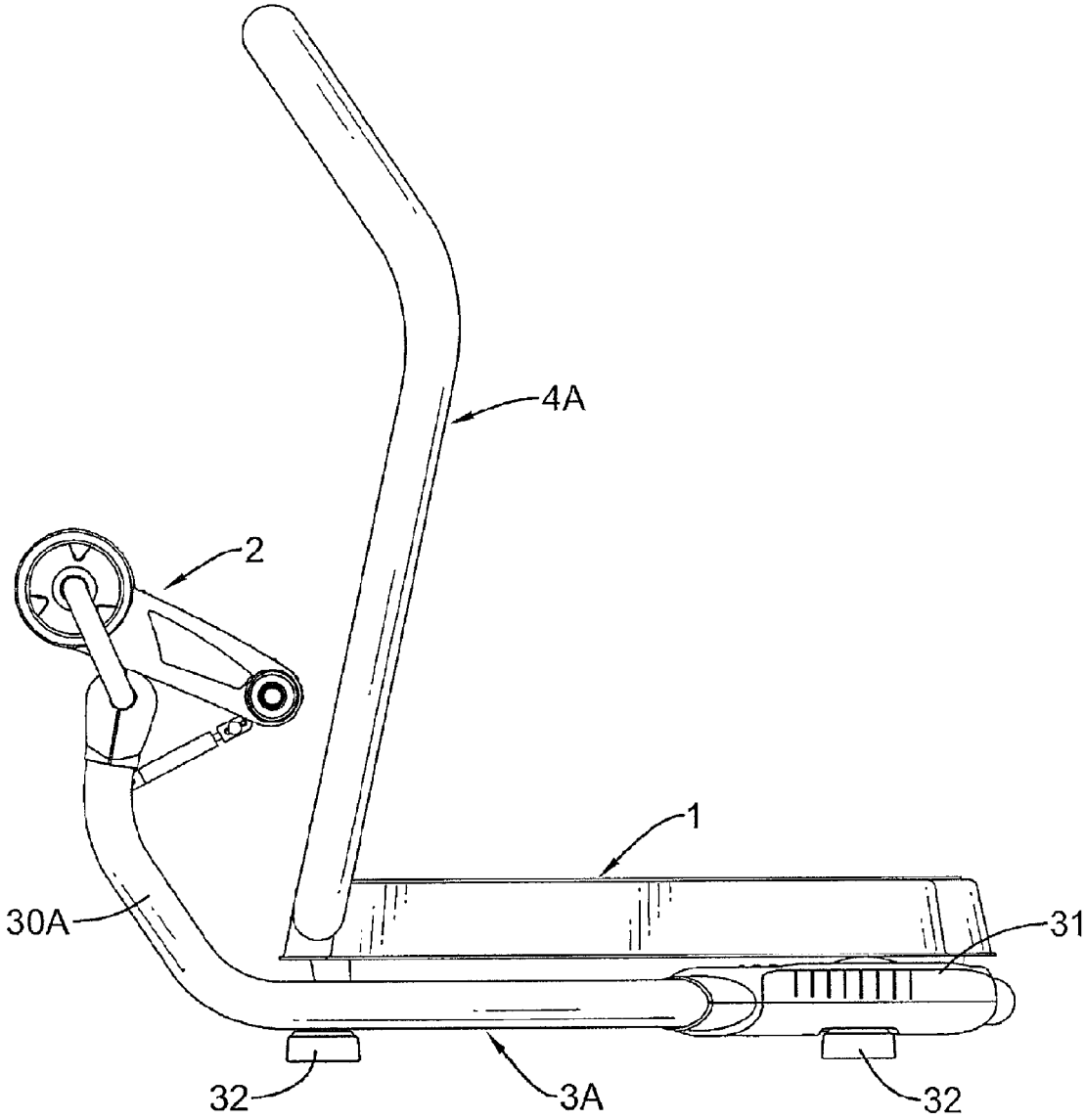
FIG. 6 is a side view of a forth embodiment of a vibration-exercising machine in accordance with the present invention.
Figure 7:
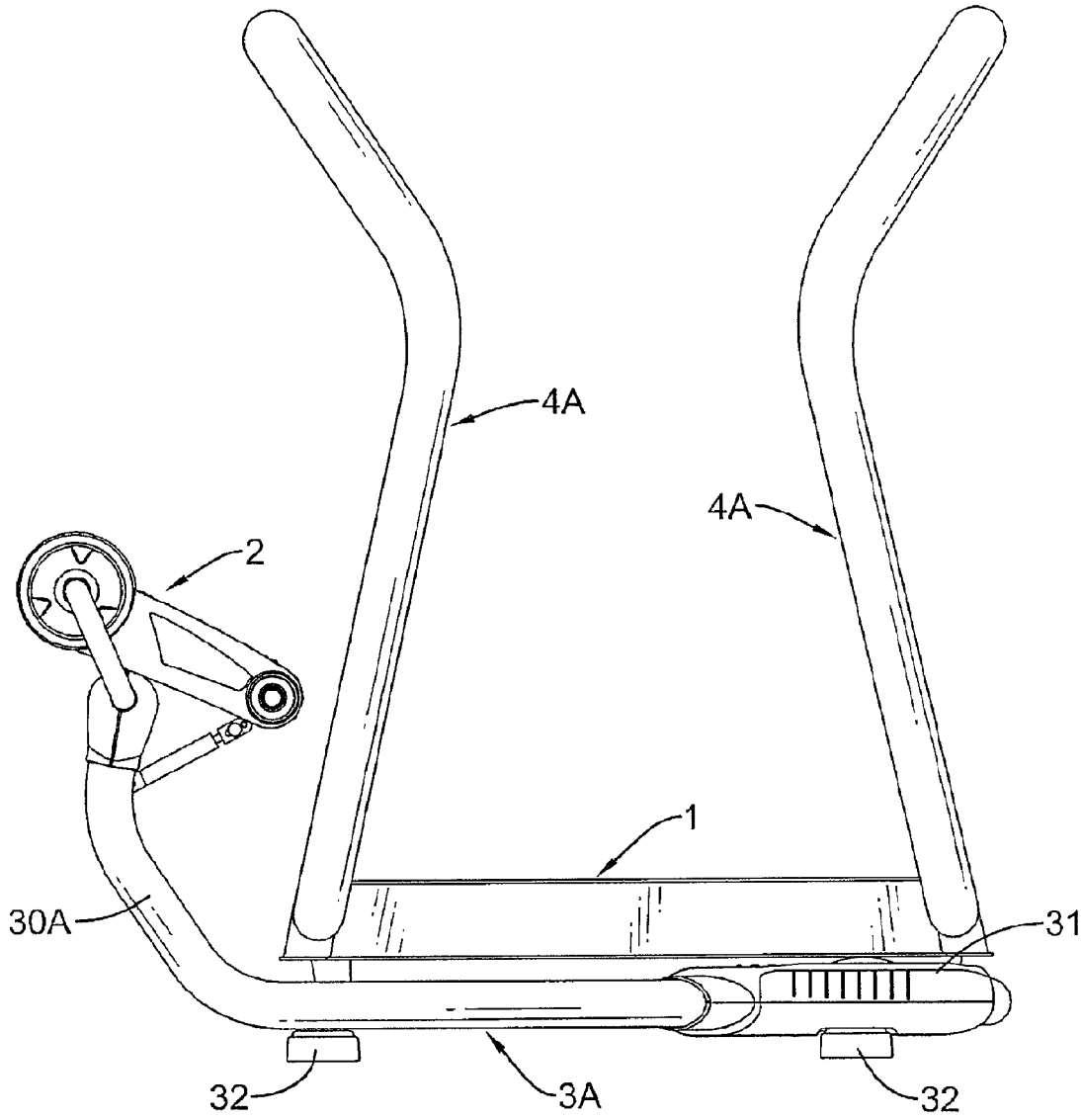
FIG. 7 is a side view of a fifth embodiment of a vibration-exercising machine in accordance with the present invention.

With reference to FIGS. 2 to 4, the supporting frame (3A, 3B) is disposed on the ground or a floor and has two ends and at least one supporter (30A, 30B) and may have at least one step (31) and multiple feet (32).

Each supporter (30A, 30B) is formed on and protrudes up from the corresponding end of the supporting frame (3A, 3B) and has a mounting end. The supporting frame (3B) may have two supporters (30B) being formed respectively on and protruding up from the ends of the supporting frame (3B).

Each step (31) is mounted on the corresponding end of the supporting frame (3A, 3B) to allow easy use of the vibration-exercising machine and may be implemented as handles. The supporting frame (3A, 3B) may have two steps (31) being opposite to each other.

The feet (32) are mounted on the supporting frame (3A, 3B) adjacent to the ground to prevent the supporting frame (3A, 3B) slipping and provide a stable base. Each foot (32) may be adjustably mounted on the supporting frame (3A, 3B) to allow adjustment and ensure the vibration-exercising machine is disposed stably on the ground without rocking.

The main platform (1) is mounted securely on the supporting frame (3A, 3B) and has an upper surface.

Each additional platform (2) is mounted on the mounting end of a corresponding supporter (30A, 30B) of the supporting frame (3A, 3B) to allow different parts of a body of the user to be placed on the additional platform (2) and become a point of contact, thereby simplifying poses, and improving comfort and ease of use of the vibration-exercising machine. The vibration-exercising machine may have two additional platforms (2) being mounted on the mounting ends of the supporters (30B) of the supporting frame (3B). Each additional platform (2) may have a distal edge, two opposite side edges, a contacting surface (20) and multiple massage protrusions (21). The massage protrusions (21) are formed on the contacting surface (20) of the additional platform (2) for additional massage.

The at least one first vibrator (6) is mounted in the main platform (1). The vibration-exercising machine may have two first vibrators (6) being mounted in the main platform (1).

Each second vibrator (60) is mounted in the corresponding additional platform (2).

The vibrators (6, 60) may be an eccentric block or a cam driven by a motor or a linkage transmission mechanism and may produce sonic waves or seesaw type waves to vibrate the main and additional platforms (1, 2). Each vibrator (6, 60) has adjustable vibration frequencies and adjustable vibration amplitudes. The vibration frequencies and the vibration amplitudes of the vibrators may be adjusted for different users.

With reference to FIGS. 5 to 8, the at least one holding frame (4A, 4B) may be mounted on and protrude up from the main platform (1), the additional platform (2) or the supporting frame (3). Each holding frame (4A, 4B) may vibrate with the main platform (1) or the additional platform (2). The vibration-exercising machine may have two holding frames (4A) being opposite to each other.

Figure 10:
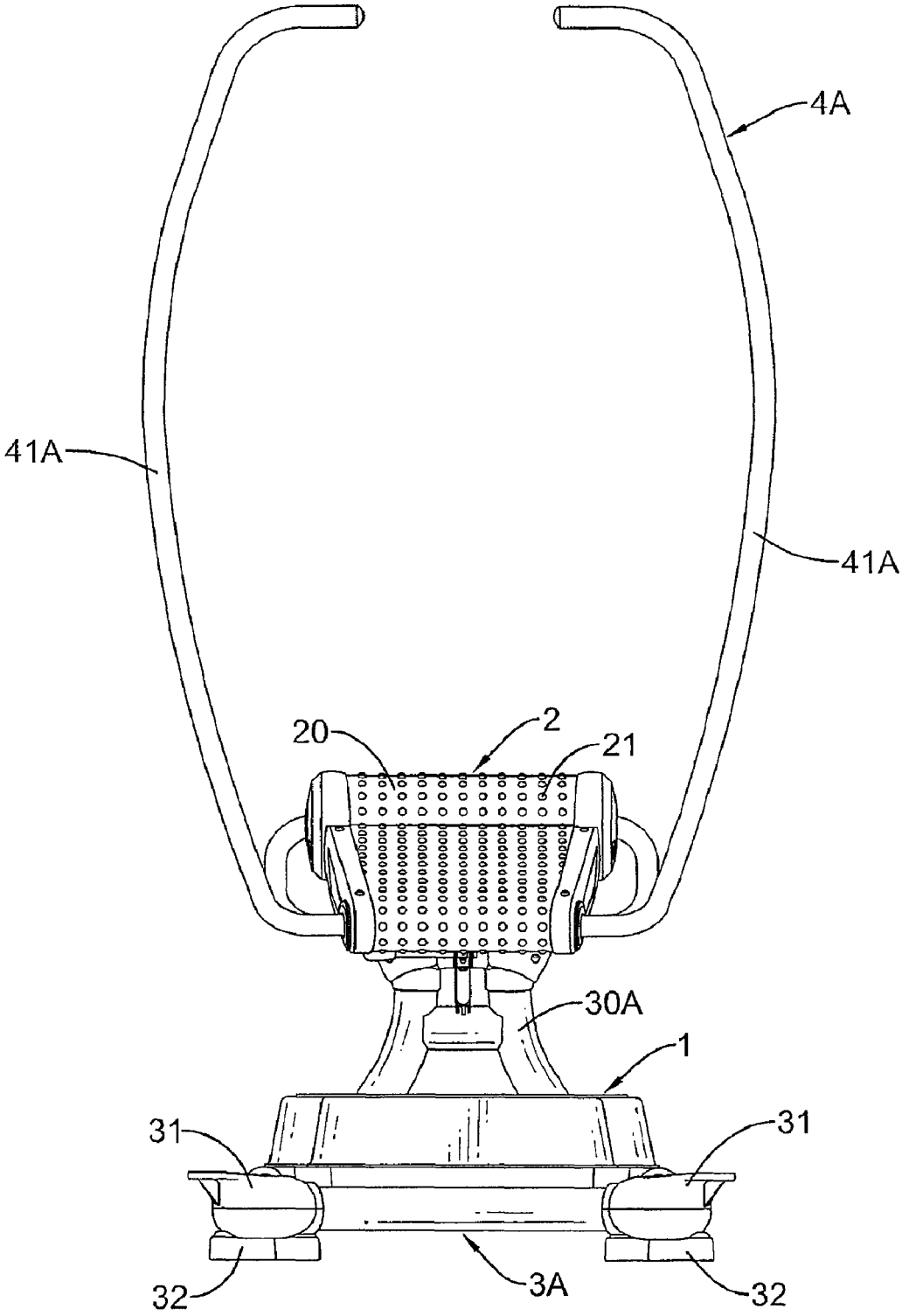
FIG. 10 is a rear view of a seventh embodiment of a vibration-exercising machine in accordance with the present invention.

With further reference to FIG. 10, each holding frame (4A) may comprise two handles (41A). The handles (41A) are mounted respectively on the side edges of the additional platform (2).

Figure 8:
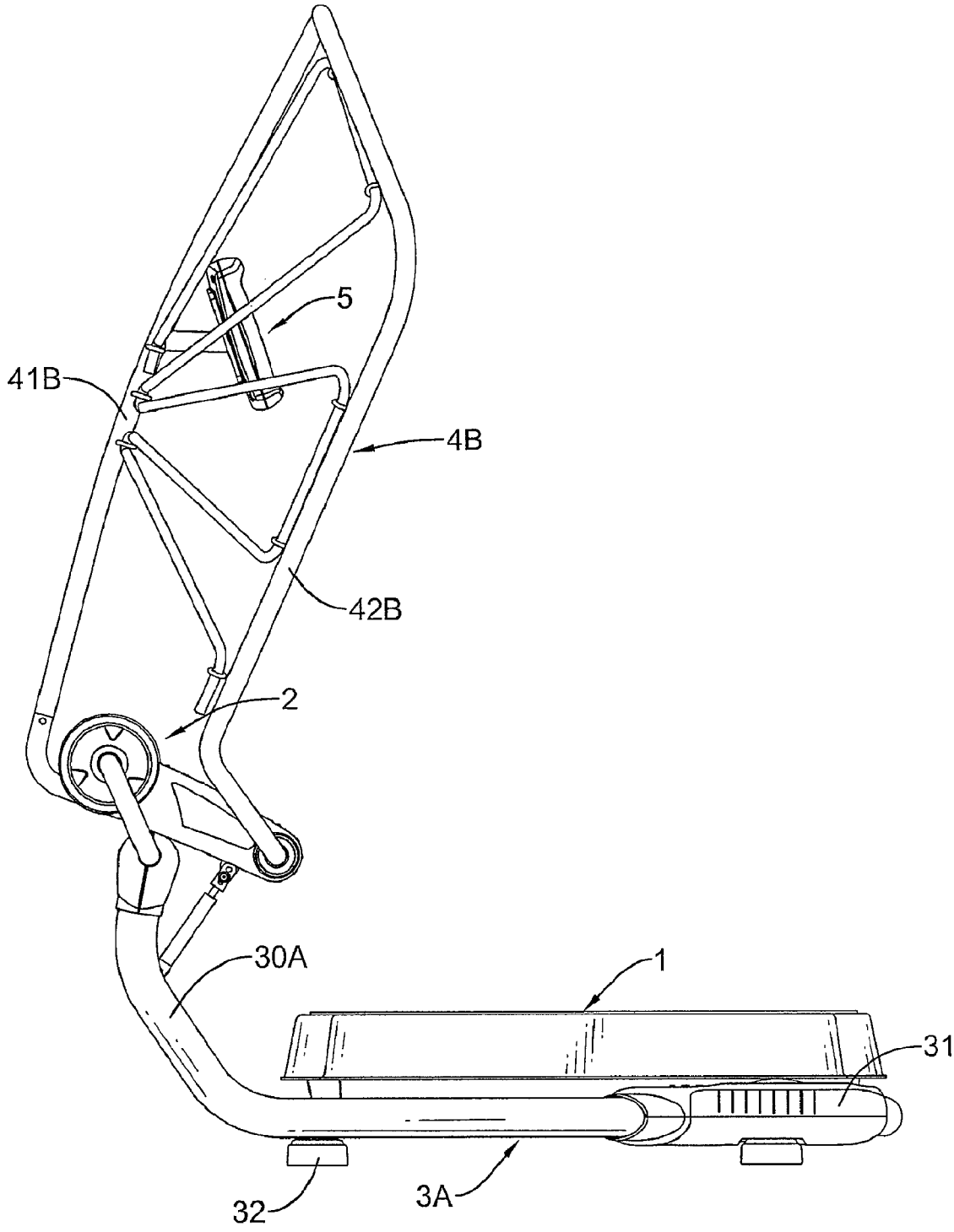
FIG. 8 is a side view of a sixth embodiment of a vibration-exercising machine in accordance with the present invention.
Figure 9:
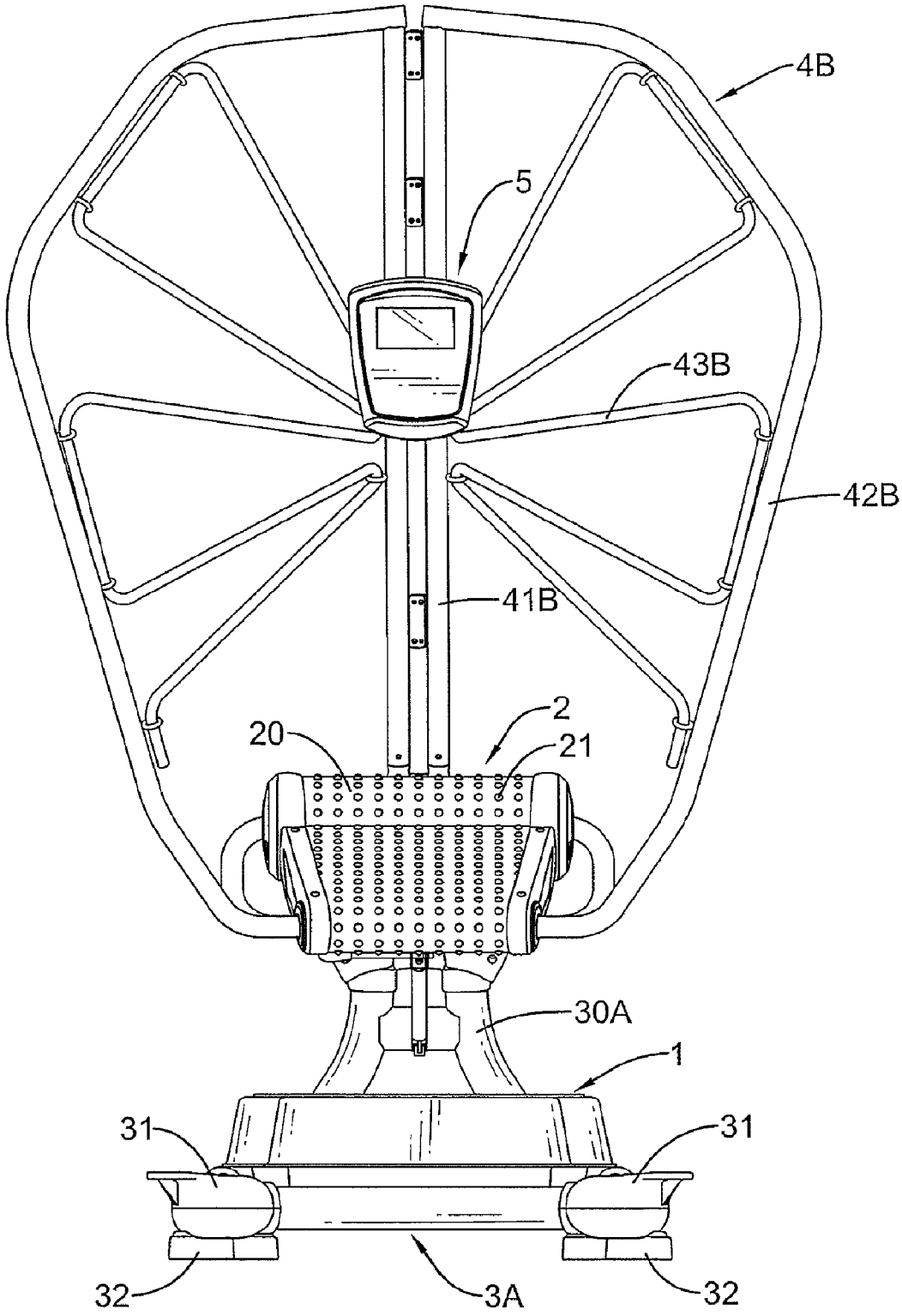
FIG. 9 is a rear view of the vibration-exercising machine in FIG. 8.

With further reference to FIGS. 8 and 9, each holding frame (4B) may have an inner frame (41B), an outer frame (42B) and multiple reinforcing bars (43B). The inner frame (41B) is mounted on and protrudes from the distal edge of the additional platform (2) and has a distal end. The outer frame (42B) is a loop, is connected to the side edges of the additional platform (2) and the distal end of the inner frame (41B). The reinforcing bars (43B) are mounted between the inner and the outer frames (41B, 42B) to strengthen the holding frame (4B).

The controller (5) is connected to the vibrators (6, 60), may be mounted on the holding frame (4A, 4B) to switch on and off the vibrators (6, 60) and to set the vibration frequencies and the vibration amplitudes of the vibrators (6). The controller (5) may be connected using a cable, or may be connected using electromagnetic waves, for instance infrared, microwaves or radio waves.

The vibration-exercising machine as described has the following advantages. The vibration-exercising machine with multiple vibrators (6, 60) being mounted respectively in the main and the additional platform (1, 2) allows different parts of a user to be vibrated and exercised efficiently at the same time. Since the additional platform (2) is mounted higher than the main platform (1), the user may exercise different body parts in comfortable and easy poses.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A vibration-exercising machine comprising:

a supporting frame having two ends; and at least one supporter, and each one of the at least one supporter being formed on and protruding up from a corresponding end of the supporting frame and having a mounting end;

a main platform being mounted securely on the supporting frame and having an upper surface;

at least one additional platform, and each one of the at least one additional platform being mounted on the mounting end of a corresponding supporter of the supporting frame and having a distal edge; and two opposite side edges;

at least one first vibrator being mounted in the main platform;

at least one second vibrator, and each one of the at least one second vibrator being mounted in the corresponding additional platform; and at least one holding frame, and each one of the at least one holding frame being mounted on, protruding up from and vibrating with the corresponding additional platform and having an inner frame being mounted on and protruding from the distal edge of the corresponding additional platform and having a distal end; and an outer frame being a loop, being connected to the side edges of the corresponding additional platform and the distal end of the inner frame.

2. The vibration-exercising machine as claimed in claim 1, wherein the vibration-exercising machine has two first vibrators being mounted in the main platform.

3. The vibration-exercising machine as claimed in claim 2, wherein the supporting frame has two supporters being formed respectively on and protruding up from the ends of the supporting frame; and the vibration-exercising machine has two additional platforms being mounted respectively on the mounting ends of the supporters of the supporting frame.

4. The vibration-exercising machine as claimed in claim 1, wherein the supporting frame has two supporters being formed respectively on and protruding up from the ends of the supporting frame; and the vibration-exercising machine has two additional platforms being mounted respectively on the mounting ends of the supporters of the supporting frame.

5. The vibration-exercising machine as claimed in claim 1, wherein each one of the at least one holding frame further has multiple reinforcing bars being mounted between the inner and the outer frames.

6. The vibration-exercising machine as claimed in claim 1, wherein the supporting frame further has at least one step and each one of the at least one step being mounted on a corresponding end of the supporting frame.

7. The vibration-exercising machine as claimed in claim 6, wherein the supporting frame has two steps being opposite to each other.

* * * * *